US006942419B2

(12) United States Patent
Knak et al.

(10) Patent No.: US 6,942,419 B2
(45) Date of Patent: Sep. 13, 2005

(54) GRATE ASSEMBLY

(75) Inventors: Ronny L. Knak, Wichita, KS (US); Dean V. Balocca, Wichita, KS (US)

(73) Assignee: Balco, Inc., Wichita, KS (US)

( * ) Notice: Subject to any disclaimer, the term of this patent is extended or adjusted under 35 U.S.C. 154(b) by 66 days.

(21) Appl. No.: 10/067,174

(22) Filed: Feb. 4, 2002

(65) Prior Publication Data

US 2003/0147693 A1 Aug. 7, 2003

(51) Int. Cl.[7] ..... E01C 11/22
(52) U.S. Cl. ..... 404/4; 404/2; 210/163
(58) Field of Search ..... 404/2, 4, 25; 405/36; 210/163, 164

(56) References Cited

U.S. PATENT DOCUMENTS

| | | | | | |
|---|---|---|---|---|---|
| 386,768 | A | * | 7/1888 | Burrows | 49/465 |
| 1,360,630 | A | * | 11/1920 | Fairtrace | 210/164 |
| 1,561,120 | A | * | 11/1925 | Smith | 210/164 |
| 3,881,832 | A | * | 5/1975 | Maguire | 404/4 |
| 3,914,911 | A | * | 10/1975 | Paasch | 52/180 |
| 4,046,482 | A | * | 9/1977 | Paasch | 404/4 |
| 4,126,404 | A | * | 11/1978 | Ferns | 404/4 |
| 4,142,329 | A | | 3/1979 | Williams | |
| 4,257,193 | A | | 3/1981 | Williams | |
| 4,387,882 | A | * | 6/1983 | Mansour et al. | 256/17 |
| 4,515,498 | A | | 5/1985 | Thomann et al. | |
| 4,553,874 | A | | 11/1985 | Thomann et al. | |
| 4,630,962 | A | | 12/1986 | Thomann et al. | |
| 4,943,100 | A | * | 7/1990 | Emberson | 210/164 |
| 4,955,752 | A | * | 9/1990 | Ferns | 404/2 |
| RE33,439 | E | | 11/1990 | Thomann et al. | |
| 5,024,550 | A | * | 6/1991 | Mainville | 404/4 |
| 5,291,714 | A | | 3/1994 | Wright et al. | |
| 5,318,376 | A | * | 6/1994 | Prescott, Sr. | 404/25 |
| 5,324,135 | A | * | 6/1994 | Smith | 404/25 |
| 5,340,232 | A | * | 8/1994 | Spiess et al. | 404/25 |
| 5,564,860 | A | | 10/1996 | Amann | |
| 5,611,640 | A | * | 3/1997 | Bowman | 404/4 |
| 5,628,152 | A | * | 5/1997 | Bowman | 52/20 |
| 5,647,689 | A | * | 7/1997 | Gunter | 405/36 |
| 5,839,852 | A | * | 11/1998 | Mattson | 405/36 |
| 6,165,357 | A | * | 12/2000 | Cormier | 210/163 |
| 6,450,125 | B2 | * | 9/2002 | McElroy | 119/529 |
| 6,537,447 | B2 | * | 3/2003 | Remon | 210/163 |
| 6,802,962 | B1 | * | 10/2004 | Browne et al. | 210/164 |

FOREIGN PATENT DOCUMENTS

| | | |
|---|---|---|
| EP | 0761885 | 3/1997 |

* cited by examiner

*Primary Examiner*—Gary S. Hartmann
(74) *Attorney, Agent, or Firm*—Hovey Williams LLP

(57) ABSTRACT

A preferred drainage system grate assembly (10) broadly comprises a grate (12), a frame (14) to support the grate (12), and a locking device (34) to hold the grate (12) within the frame (14). The grate (12) comprises two or more crossbars (16) and a plurality of tread bars (18). Each crossbar (16) spans a watercourse (20) of a drainage system (21) and is supported by the frame (14) at both ends. The crossbar (16) includes an integral flange (56) that protrudes from the crossbar (16) substantially horizontally and at least one hole (60) centered within the flange (56). The locking device (34) includes a penetration (46) where a bolt (36) is inserted through the hole (60). As the bolt (36) is turned, the locking device (34) is raised until it contacts the frame (14), thereby securing the grate (12) within the frame (14).

13 Claims, 3 Drawing Sheets

GRATE ASSEMBLY

BACKGROUND OF THE INVENTION

1. Field of the Invention

The present invention relates to drainage system grate assemblies. More particularly, the present invention relates to a drainage system grate assembly including a drainage system grate that can be secured over a drainage system without deforming the grate or causing a tripping hazard.

2. Description of the Prior Art

Drainage system grates are typically comprised of several tread bars and two or more crossbars that drop into frames to cover drainage systems. The frames are typically secured over or within a drainage system, while it is being constructed. The frames not only support the grates, but also provide a convenient platform to which the grates may be secured.

Drainage system grates are typically secured to their frames by grate locking assemblies to prevent theft by vandals or thieves and to ensure that the grates don't become unseated by heavy use. Stolen or unseated grates are hazardous, because a removed or unseated grate cannot prevent a person or a vehicle from falling into a drainage system.

Common grate locking assemblies typically include a grate bar affixed either above or below a few tread bars of a grate. A bolt is used to secure the grate bar to a locking bar, which is located within the drainage system and contacts the grate's frame to prevent the grate from being removed or unseated.

There are two main problems with these assemblies. One is that the grate bar must be added to an otherwise ready-to-install grate. This complicates the installation and can result in an aesthetically unappealing grate.

Another problem is that the grate bar is typically only affixed to some tread bars. This stresses those tread bars and not others. The stressed tread bars can bend and cause an uneven surface. The uneven surface is aesthetically unappealing and can present a tripping hazard.

Another common grate locking assembly uses a recessed area in two adjacent tread bars of a grate. The recessed area includes a hole through which a bolt penetrates, such that a head of the bolt rests in the recessed area. The bolt is attached to a locking bar below the grate allowing the locking bar to be rotated, such that ends of the locking bar seat within grooves in a frame. The grooves prevent the locking bar and the grate from being removed or unseated. A disadvantage of this construction is that only two tread bars are stressed, which can cause an uneven surface as discussed above.

Accordingly, there is a need for an improved drainage system grate assembly that overcomes the limitations of the prior art.

SUMMARY OF THE INVENTION

The drainage system grate assembly of the present invention overcomes the above-identified problems and provides a distinct advance in the art. More particularly, the present invention relates to a drainage system grate assembly including a drainage system grate that can be secured over a drainage system without deforming the grate or causing a tripping hazard.

The preferred drainage system grate assembly broadly comprises a grate, a frame to support the grate, and a locking device to hold the grate within the frame. The grate comprises two or more crossbars and a plurality of tread bars. Each crossbar spans a watercourse of a drainage system and is supported by the frame at both ends of the crossbar. The crossbar includes an integral flange. The flange protrudes from the crossbar substantially horizontally and includes at least one hole centered within the flange.

Each tread bar spans the watercourse perpendicularly from and is supported by the crossbars. Each tread bar seats in a channel in each crossbar and includes a course upper surface to ensure good traction and prevent a person or vehicle from slipping as they traverse over the watercourse.

The frame is typically formed or set into the watercourse during construction of the drainage system. The frame includes ledges which support the crossbars and sidewalls which prevent the grate from moving laterally. The frame also typically includes shelves.

The locking device comprises a substantially horizontal member, a nut retaining member, and two substantially vertical members. The substantially horizontal member includes a penetration where a bolt is inserted through the hole in the flange to engage a nut in the nut retaining member.

As the bolt is turned, the locking device is raised until one of the substantially vertical members contacts one of the shelves in the frame. The substantially vertical member contacting one of the shelves of the frame secures the grate within the frame.

A locking bar may be used as an alternative to the locking device. The locking bar is used similarly to the locking device except that it spans the watercourse and contacts shelves of the frame on either edge of the watercourse.

In use, an installer prepares the grate assembly by inserting the bolt through the hole in the flange and the penetration to engage the nut slightly. The installer then positions the locking device or the locking bar so that it will not contact the frame on the way down. Then, the installer seats the grate within the frame and repositions the locking device or locking bar so that it will contact the frame on the way up. When the locking device or locking bar is in position, the installer turns the bolt until the locking device or the locking bar contacts the shelves of the frame, thereby securing the grate within the frame.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
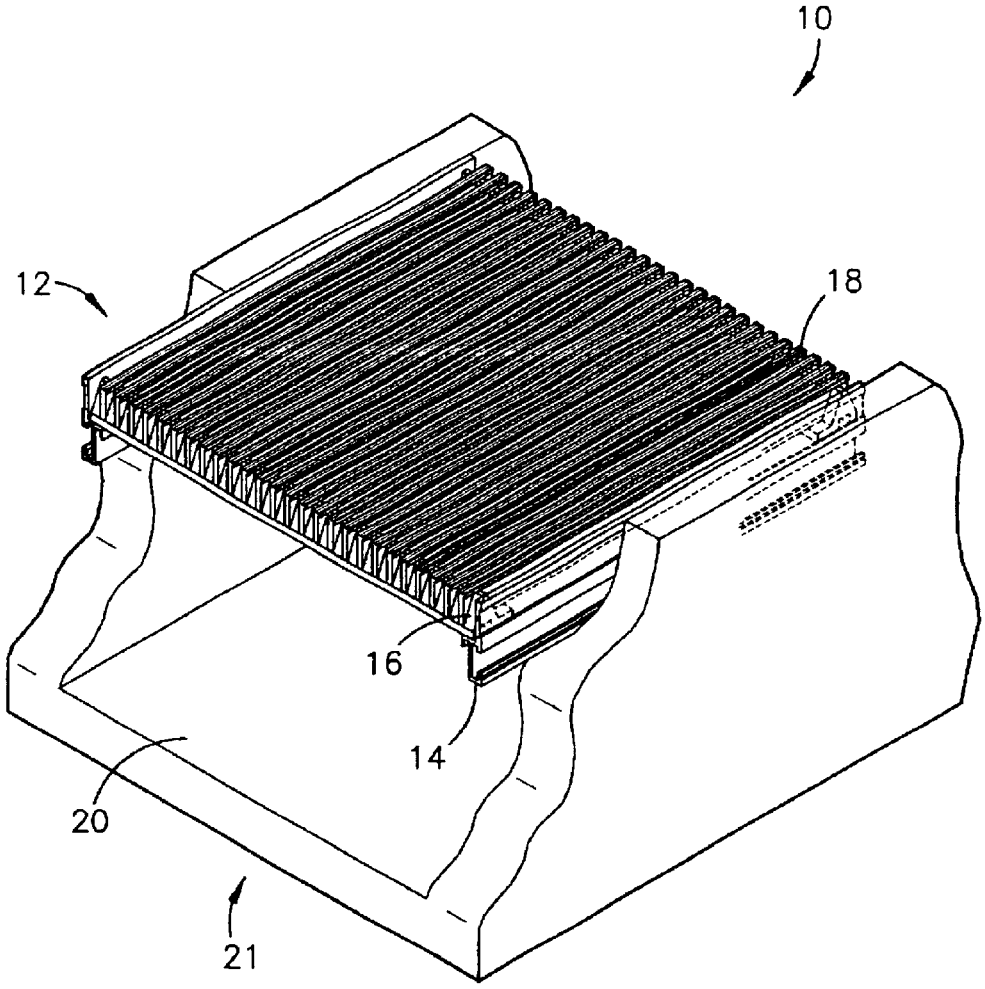
FIG. 1 is a perspective view of a drainage grate assembly constructed in accordance with a preferred embodiment of the present invention and shown covering a watercourse of a drainage system.

Referring to FIG. 1, a drainage system grate assembly 10 constructed in accordance with a preferred first embodiment of the invention broadly comprises a grate 12 seated within and supported by a frame 14. The grate 12 comprises two or more crossbars 16 and a plurality of tread bars 18. Each crossbar 16 spans a watercourse 20 of a drainage system 21 and is supported by the frame 14 at both ends.

Figure 2:
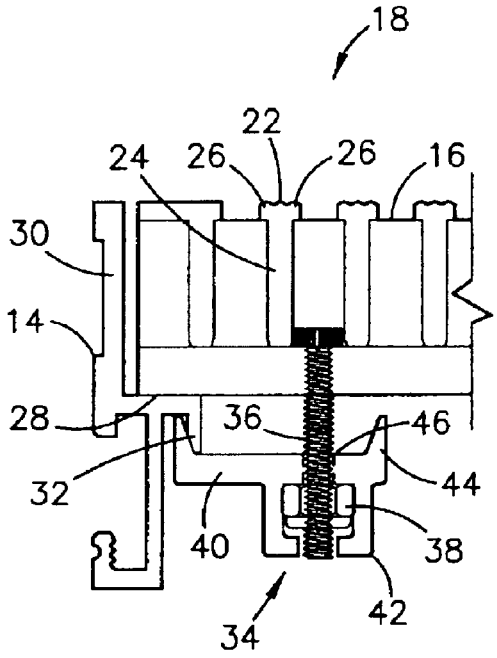
FIG. 2 is a partial elevation view of a preferred first embodiment of a grate seated within a frame and secured therein by a locking device.

Also referring to FIG. 2, each tread bar 18 spans the watercourse 20 perpendicularly from and is supported by the crossbars 16. Each tread bar 18 includes a substantially horizontal grip portion 22 and a substantially vertical channel portion 24. The grip portion 22 has a course upper surface to ensure good traction and prevent a person or vehicle from slipping as they traverse over the watercourse 20, and two shoulders 26. Each tread bar 18 is preferably constructed of extruded aluminum but may be formed of any rigid material.

The frame 14 is typically formed or set into the watercourse 20 during construction of the drainage system 21. The frame 14 can completely circumvent the watercourse 20 or only reside on two opposing edges of the watercourse 20. The frame 14 includes substantially horizontal ledges 28 which support the crossbars 16 and substantially vertical sidewalls 30 which prevent the grate 12 from moving laterally. The frame 14 also includes one or more shelves 32. The frame 14 is preferably constructed of extruded aluminum, but may be any rigid material.

Referring to FIGS. 1 and 2, the grate assembly 10 also includes a locking device 34 which is attached between the grate 12 and the frame 14 by a bolt 36, and a nut 38 for securing the grate 12 over the watercourse 20. The locking device 34 comprises a horizontal member 40, a nut retaining member 42, and two vertical members 44. The horizontal member 40 includes a penetration 46 where the bolt 36 penetrates and engages the nut 38 in the nut retaining member 42. The locking device 34 is preferably constructed of extruded aluminum but may be formed of any rigid material.

During installation of the grate, the bolt 36 supports the locking device 34 below the grate 12. Once the grate 12 is installed, the bolt 36 may be turned to raise the locking device 34 until one of the vertical members 44 contacts one of the shelves 32 of the frame 14. The vertical member 44 contacting one of the shelves 32 secures the grate 12 within the frame 14.

Figure 3:
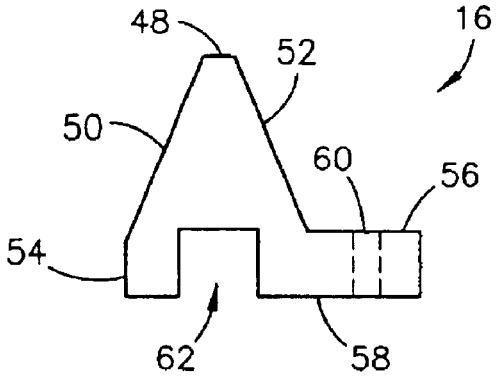
FIG. 3 is an elevation view of a preferred first embodiment of a crossbar.

Also referring to FIG. 3, each crossbar 16 includes a substantially horizontal top surface 48, a first and a second slanted side 50, 52 adjacent to and on opposite edges of the top surface 48, a substantially vertical sidewall 54 adjacent the first slanted side 50, an integral flange 56 adjacent the second slanted side 52, and a substantially horizontal bottom surface 58. Each crossbar 16 is preferably constructed of extruded aluminum but may be formed of any rigid material. Each crossbar 16 is approximately 1.125 inches tall and approximately 1.38 inches wide. The length of each crossbar 16 is determined by the width of the frame 14, which is determined by the width of the watercourse 20. The present invention can be designed to accommodate any watercourse 20, therefore, the length and width of each crossbar 16 is a matter of design choice.

The top surface 48 is approximately 0.15 inches wide. Each slanted side 50,52 is sloped inward at an approximately 23° angle from the vertical. The sidewall 54 is approximately 0.25 inches tall. The flange 56 is approximately 0.305 inches thick and extends substantially horizontally approximately 0.5 inches from where it adjoins the second slanted side 52.

One or more holes 60 are substantially centered in the flange 56 and laterally spaced approximately 0.75 inches on center. Each hole 60 has an approximately 0.25 inch diameter.

Additionally, a slot 62 is cut into the bottom surface 58 along the length of each crossbar 16. The slot 62 is approximately 0.375 inches wide and approximately 0.315 inches deep. The slot 62 is centered below the top surface 48.

Figure 4:
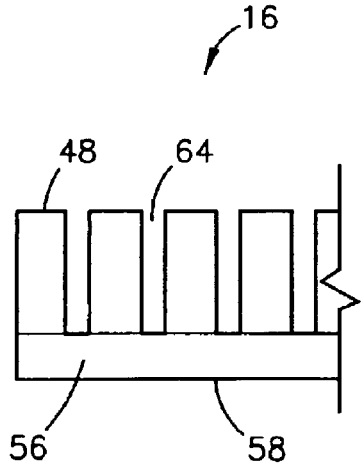
FIG. 4 is a partial elevation view of the crossbar of FIG. 3.

Also referring to FIG. 4, a plurality of channels 64 are cut into the top surface 48 across each crossbar 16 to support the tread bars 18. The channels 64 are approximately 0.25 inches wide and approximately 0.82 inches deep spaced approximately 0.5 inches apart. Each hole 60 is substantially centered between the channels 64.

The shoulders 26 of the tread bars 18 rest on the top surface 48 of the crossbar 16. The channel portion 42 of the tread bars 18 seats within one of the channels 36 of each crossbar 16. As can be seen by the given dimensions, the slot 62 is of sufficient depth so as to meet each channel 64 and allow the tread bars 18 to be secured to the crossbar 16 by welding a bead along the slot 62.

Figure 5:
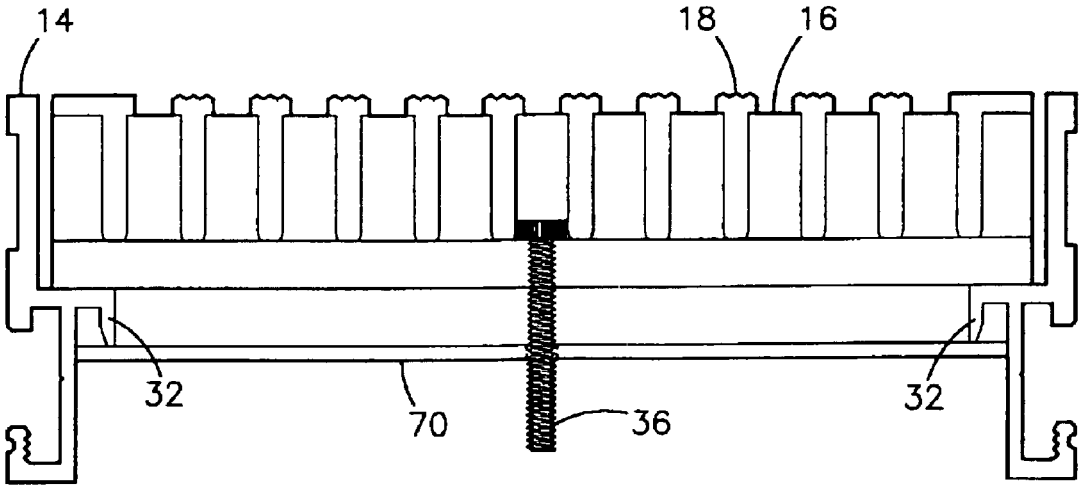
FIG. 5 is an elevation view of the grate of FIG. 2 seated within the frame and secured therein by a locking bar.

Also referring to FIG. 5, a locking bar 70 may be used to replace the locking device 34. The locking bar 70 is used similarly to the locking device 34 except that it spans the watercourse 20 and contacts the shelves 32 of the frame 14 on either edge of the watercourse 20. The nut 38 may be attached to the locking bar 70 via a retaining member similar to the retaining member 42 of the locking device 34. Alternatively, the locking device 34 or the locking bar 70 may be threaded to engage the bolt 36.

In use, an installer prepares the grate 12 by inserting the bolt 36 through the hole 60 in the flange 56 and the penetration 46 in either the locking device 34 or the locking bar 70, engaging the nut 38 slightly. The installer then positions the locking device 34 or the locking bar 70 so that it will not contact the frame 14 on the way down. Then, the installer seats the grate 12 within the frame 14 and repositions the locking device 34 or the locking bar 70 in position below the shelves 32 of the frame 14. As the installer turns the bolt 36, the locking device 34 or the locking bar 70 rises to contact the shelves 32 of the frame 14, thereby securing the grate 12 within the frame 14.

Figure 6:
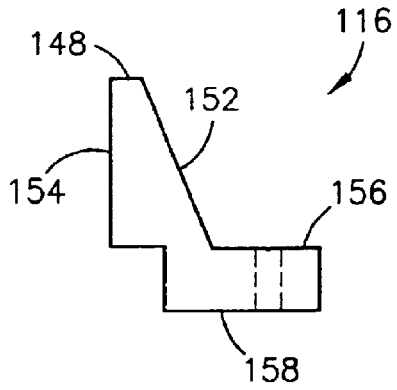
FIG. 6 is an elevation view of a preferred second embodiment of a crossbar.

Referring to FIG. 6, a crossbar 116 of a preferred second embodiment is similar to the crossbar 16 of the preferred first embodiment and includes a substantially horizontal top surface 148, a substantially vertical sidewall 154 adjacent the top surface 148, a slanted side 152 adjacent the top surface 148, an integral flange 156 adjacent the slanted side 152, and a substantially horizontal bottom surface 158. In all other respects, the crossbar 116 of the preferred second embodiment is preferably identical to the crossbar 16 of the preferred first embodiment.

Figure 7:
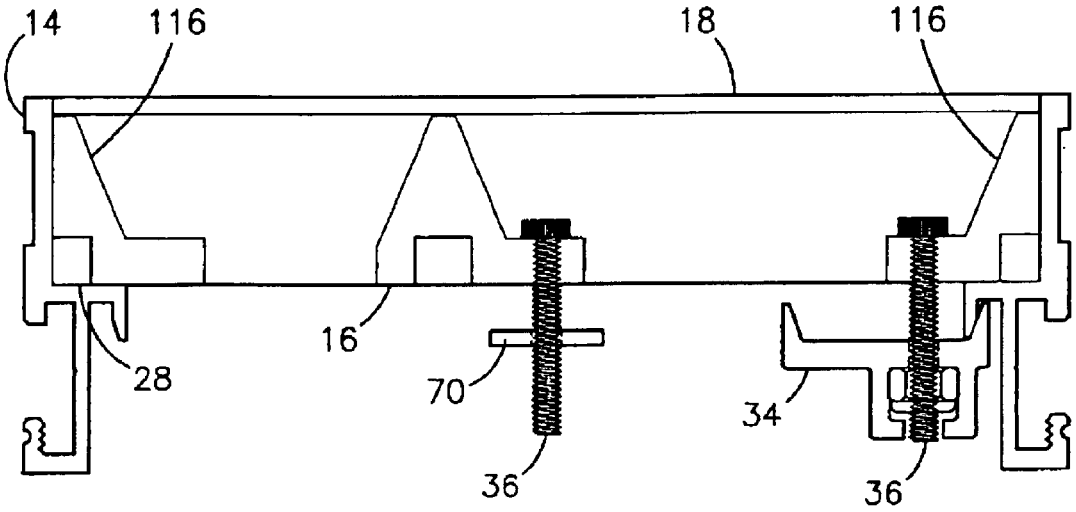
FIG. 7 is an elevation view of a grate comprising the crossbar of FIG. 3 and the crossbar of FIG. 6 seated within the frame showing the locking device and the locking bar.

Referring to FIG. 7, the crossbar 116 is typically used near ends of the tread bars 18 and along the ledges 28 of the frame 14. The crossbar 116 of the preferred second embodiment can also be used in conjunction with the crossbar 16 of the preferred first embodiment.

It can be seen that the slanted sides 24,26,152 of both crossbars 16,116 can act to divert water and other debris around the crossbar 16, 116, thus allowing the water to collect in the watercourse 20. While the crossbar 16 of the preferred first embodiment is more stable than the crossbar 116 of the preferred second embodiment, the crossbar 116 of the preferred second embodiment is better suited to be located along the ledges 28 of the frame 14. This is because the sidewall 154 can be seated flush with the frame 14 and the slanted side 152 can divert water into the watercourse 20. If the crossbar 16 of the preferred first embodiment were to be located along the ledges 28 of the frame 14, the first slanted side 50 could trap water against the frame 14. Trapped water may cause corrosion or sanitation problems.

While the present invention has been described above, it is understood that other materials and/or dimensions can be substituted. Additionally, items which have been described as preferably identical to another item may have differences, as a mater of design choice. These and other minor modifications are within the scope of the present invention.

Having thus described a preferred embodiment of the invention, what is claimed as new and desired to be protected by Letters Patent includes the following:

1. A drainage system grate assembly for covering a watercourse of a drainage system, the drainage system assembly comprising:

a frame set within the watercourse;

a grate set within the frame and including— at least one crossbar having a length, a width, and opposing ends, wherein the crossbar spans the watercourse alone the crossbar's length, and further wherein the crossbar is operable to be secured to the frame at each general end of the crossbar, a plurality of channels cut into each crossbar, thereby defining a plurality upstanding members located along the length of each crossbar, and a plurality of tread bars positioned between each upstanding member, such that the tread bars are supported by and positioned on top of the at least one crossbar; and at least one locking element, each of which is structurally separate from the frame and grate and of a rigid construction, such that each locking element is operable to interface with the frame so as to secure each crossbar to the frame.

2. The drainage system grate assembly as et forth in claim 1, wherein the frame includes a horizontal ledge protruding towards the opposing side of the frame.

3. The drainage system grate assembly as et forth in claim 2, wherein the frame includes a shelf extending downwardly from each horizontal ledge.

4. The drainage system grate assembly as set forth in claim 1, wherein the locking element comprises a bar having a length approximately a least the same as a length of the at least one crossbar.

5. The drainage system grate assembly as set forth in claim 1, wherein each upstanding member of each crossbar includes a flange protruding horizontally from the upstanding member and operable to interface the upstanding members with the locking element, so as to secure the grate to the frame.

6. The drainage system grate assembly as set forth in claim 3, the locking element including an upturned, vertical member adapted to interface with and contact the downwardly extending shelf of the frame so as to secure the crossbar to the frame.

7. The drainage system grate assembly as set forth in claim 1, wherein the grate is a first grate and the drainage system grate assembly further comprises a second grate positioned adjacent the first grate.

8. The drainage system grate assembly as set forth in claim 1, wherein in a first orientation, a length of the at least one crossbar is generally perpendicular to the opposing sides of the frame, and in a second orientation, the length of the at least one crossbar is generally parallel to the opposing sides of the frame.

9. The drainage system grate assembly as set forth in claim 1, wherein the locking element is a first locking element and further including a second locking element, such that the first and second locking elements secure opposing ends of the crossbar to the frame.

10. The drainage system grate assembly as set forth in claim 1, wherein the locking element must be manually actuated for engagement of the locking element wit the frame so as to secure the grate within the frame.

11. The drainage system grate assembly as set forth in claim 1, wherein the locking element is raised along a generally vertical axis, so as to engage the locking element in securing relationship with the frame.

12. The drainage system grate assembly as set forth in claim 1, wherein the upstanding members positioned on the crossbar do not extend substantially beyond the width of the crossbar.

13. The drainage system grate assembly as set forth in claim 1, wherein a top of the tread bars positioned on and supported by the crossbars is generally flush with opposing shoulders of the watercourse.

* * * * *